United States Patent [19]

Copeland et al.

[11] Patent Number: 4,845,965

[45] Date of Patent: Jul. 11, 1989

[54] METHOD AND APPARATUS FOR DISPENSING SOLUTIONS

[75] Inventors: James L. Copeland, Burnsville; Daniel F. Brady, Eagan, both of Minn.

[73] Assignee: Ecolab Inc., St. Paul, Minn.

[21] Appl. No.: 945,908

[22] Filed: Dec. 23, 1986

[51] Int. Cl.[4] ..... D06F 39/02

[52] U.S. Cl. ..... 68/17 R; 68/207; 134/93; 222/64

[58] Field of Search ..... 68/17 R, 207; 134/93; 137/268, 861; 222/64; 8/158

[56] References Cited

U.S. PATENT DOCUMENTS

| | | | |
|---|---|---|---|
| 1,945,261 | 4/1934 | Pierce | 137/861 |
| 2,308,612 | 1/1943 | Lehmkuhl | 23/272 |
| 2,371,720 | 8/1943 | Stine | 299/83 |
| 2,802,724 | 8/1957 | Johnson | 23/267 |
| 3,044,285 | 7/1962 | Koplin | 68/17 R X |
| 3,160,317 | 12/1964 | Hambro | 68/17 R |
| 3,219,050 | 11/1965 | Ericson | 137/268 X |
| 3,229,709 | 1/1966 | Gerken | 137/268 |
| 3,319,637 | 5/1967 | Gore et al. | 134/57 |
| 3,595,433 | 7/1971 | Daley et al. | 222/67 |
| 3,680,070 | 7/1972 | Nystuen | 340/244 |
| 3,727,889 | 4/1973 | Nagel | 259/1 |
| 3,771,333 | 11/1973 | Jurjans | 68/207 X |
| 3,816,427 | 6/1974 | Loliger e al | 23/271 |
| 3,850,344 | 11/1974 | Burge et al. | 222/67 |
| 3,891,123 | 6/1975 | Blackburn | 68/207 X |
| 4,020,865 | 5/1977 | Moffat et al. | 137/268 |
| 4,063,663 | 12/1977 | Larson et al. | 222/52 |
| 4,357,953 | 11/1982 | Patterson | 137/268 X |
| 4,426,362 | 1/1984 | Copeland et al. | 422/263 |
| 4,444,730 | 4/1984 | Renders et al. | 134/93 X |
| 4,463,582 | 8/1984 | Saalmann et al. | 68/207 X |
| 4,687,121 | 8/1987 | Copeland | 137/268 X |
| 4,691,850 | 9/1987 | Kirschmann et al. | 222/642 |

*Primary Examiner*—Frankie L. Stinson

*Attorney, Agent, or Firm*—Merchant, Gould, Smith, Edell, Welter & Schmidt

[57] ABSTRACT

A dispenser suitable for dispensing multiple solutions to, preferably, multiple utilization points. A laundry washing system (18) according to the invention includes a dispenser (20) which dispenses a plurality of cleaning solution to a plurality of washing machines (72) through a single common conduit (25). Conduit (25) is flushed after dispensing one solution but before dispensing a second chemically incompatible solution. A preferred dispenser (20) is capable of servicing multiple laundry machines (72) using a first-in first-out approach wherein the machines request service from a control system (74) which temporarily disables any "late-comers" until the appropriate solution can be dispensed to the machine (72) making the first, or highest priority, request.

21 Claims, 3 Drawing Sheets

METHOD AND APPARATUS FOR DISPENSING SOLUTIONS

FIELD OF THE INVENTION

The invention relates generally to dispensing solutions to a utilization point. More particularly, it relates to dispensing multiple cleaning solutions to one or more laundry machines using, preferably, a single delivery system.

BACKGROUND OF THE INVENTION

Chemical cleaning compounds have long been advantageously used in a variety of contexts. Such compounds are produced in solid, granulated or powdered, and liquid forms. Typically, a cleaning compound is mixed with a solvent (e.g., water) to form a cleaning solution. Preferred embodiments of the present invention include methods and apparatus for dispensing cleaning solutions to a "utilization point," e.g., a dishwashing or laundry washing machine. Since one very common utilization point is a laundry machine, the present invention will be described in this context. It should be emphasized that the present invention is not limited to laundry washing applications, however.

In most commercial laundry machines it is desirable to dispense more than one type of solution to the washing zone. For example, detergent, fabric softener, souring agent and bleach are often utilized. These products are typically entirely incompatible: the detergent is alkaline, the souring agent is acidic, and the bleach is, for example, sodium hypochlorite (NaOCl) or the like. If the acidic souring agent comes into contact with the bleach, toxic chlorine gas can form. Also, if the alkaline detergent encounters the acidic sour, or vice versa, neutralization and loss of the desired effect will occur to some degree. Thus, laundry machines have historically possessed cleaning solution dispensers having an independent delivery system (e.g., separate conduit and pump) for each incompatible solution. While this technique is generally useful for its intended purpose, it is also unnecessarily expensive since each independent delivery system requires its own pump, its own delivery conduit, and so on. The capital cost of such a system becomes particularly high when sensors (e.g., conductivity and/or temperature sensors) are used in each individual delivery system. Not only are such systems unnecessarily expensive, they can be unsightly, space-consuming and possess a greater risk of failure (because of the larger number of fittings and components). The present invention is directed toward methods and apparatus for delivering multiple, possibly incompatible, products using a single delivery system.

Continuing with the laundry washing example, commercial laundries often have several laundry machines. As discussed above, associated with each of the laundry machines is a cleaning product dispenser capable of dispensing detergent, softener, souring agent and bleach, through three or four independent delivery systems. Particularly in view of the fact that automatic dispensers are so expensive, there is a need for a dispenser which can service more than one laundry machine. Preferred dispensers of the present invention possess this capability. Still another problem with prior art laundry machines is that very concentrated cleaning chemicals are delivered to the washing basin at various times during the washing cycles. Use of such concentrated solutions diminishes the useful lives of the components (tubes, fittings, pumps, and the like). Further, when these concentrated solutions are dumped into the washing basin, the laundry which first receives the concentrated solutions will be most affected, leading to non-uniform cleaning and, in extreme cases, permanent staining.

In view of the above, preferred embodiments of the present invention include dispensers for handling multiple products (with a single delivery system) and multiple laundry machines, and which are also capable of delivering relatively dilute cleaning solutions.

SUMMARY OF THE INVENTION

The invention includes a chemical dispenser suitable for dispensing a plurality of chemical solutions to a utilization point comprising:

(a) a fluid handling system comprising:

(i) a plurality of chemical solution sources;

(ii) a fluidly common means for placing the chemical solution sources in fluid communication with the utilization point; and (iii) means for flushing the fluidly common means; and (b) a control system in operative contact with the fluid handling system suitable for activating the fluid handling system to alternately dispense the chemical solutions to the utilization point during dispensing periods and for activating the flushing means to flush the fluidly common means between dispensing periods.

In a preferred embodiment the chemical solutions include an alkaline laundry detergent, an acidic laundry softener, and a bleach. The detergent and softener can be stored in solid form and the bleach in liquid form.

Preferred embodiments also include a conductivity sensor as a means for controlling the dispensing periods.

Another dispenser embodiment is suitable for alternately dispensing chemical solutions to a plurality of laundry machines. The laundry machines can request a chemical solution, and the control system can respond to those requests on a first-in first-out basis. That is, the control system of the dispenser can interact with a laundry machine and place it in a "hold" condition until the dispenser is ready to respond to the laundry machine's request for a chemical solution.

The invention also includes a method for dispensing a plurality of chemical solutions to a utilization point comprising the steps of:

(a) alternately directing the chemical solutions to the utilization point through a common solution conduit during dispensing periods; and (b) flushing the common solution conduit between dispensing periods.

DESCRIPTION OF PREFERRED EMBODIMENT

Figure 1:
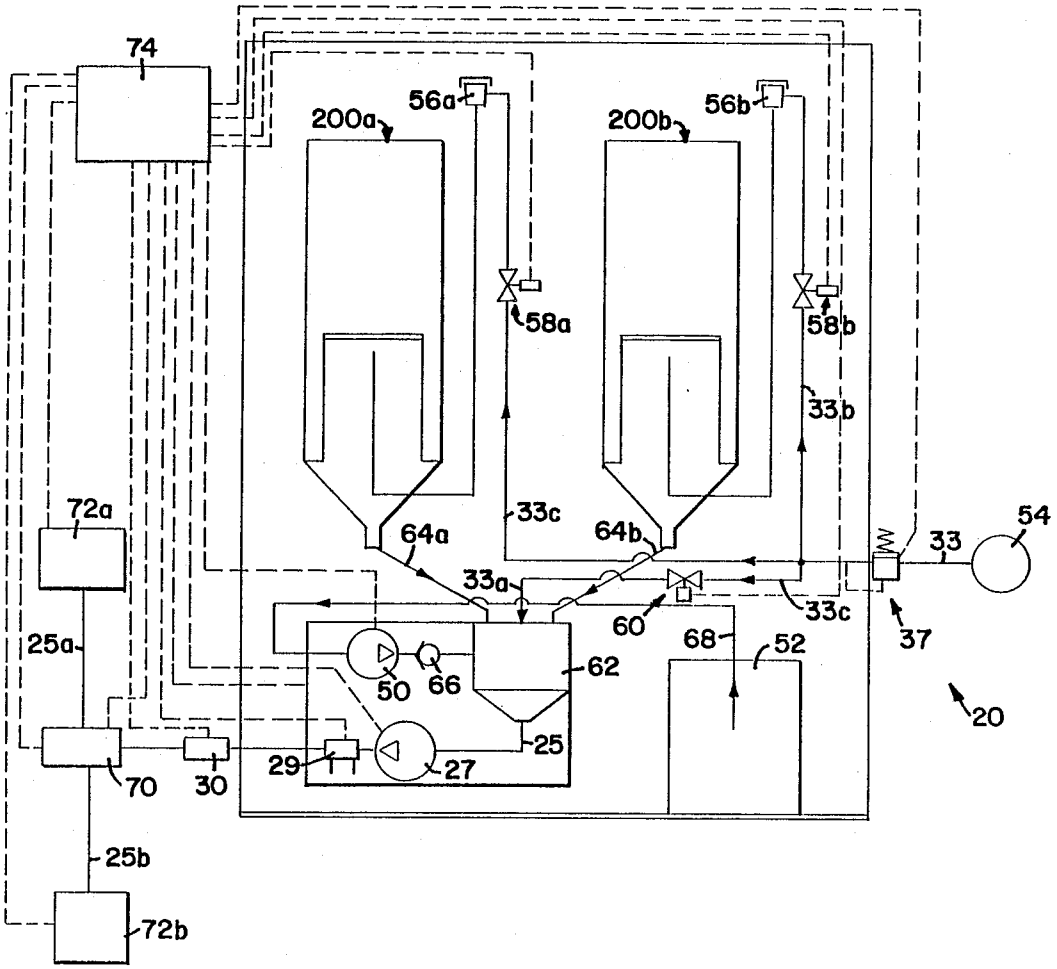
FIG. 1 is a diagrammatic view of a preferred laundry washing system according to the invention.

FIG. 1 shows a schematic or diagrammatic view of a laundry washing system 18 according to the invention. System 18 includes a dispenser 20 suitable for dispensing multiple products to multiple utilization points using a single delivery system. Dispenser 20 will be described in terms of dispensing detergent, softener and bleach to a pair of laundry machines 72. It should be noted, however, that the dispenser 20 could work equally well for the dispensing of any chemical to any utilization point(s).

Employing a laundry washing example, dispenser 20 includes a pair of containers 200*a* and 200*b* which respectively contain solid alkaline laundry detergent and solid sour softener, as further described below. The containers 200*a* and 200*b* are preferably of the type described in commonly-owned copending U.S. patent application Ser. No. 796,017, filed Nov. 6, 1985, incorporated herein by reference. That is, they can be hollow sleeves or the like containing solid product and having a funnel-shaped lower portion. A spray head is mounted so that water can be sprayed at the solid product, with the resulting solution draining into the funnel-shaped portion and through the outlet of the container 200.

Dispenser 20 also preferably includes a source 52 of liquid bleach. At preselected times ("dispensing periods") during a cleaning cycle, detergent, softener and bleach are individually dispensed to one or more laundry machines 72 as further described below.

Containers 200*a* and 200*b* are coupled to a supply of water 54 by a feed line 33. Respectively interposed between containers 200*a* and 200*b* and water supply 54 are vacuum breakers 56*a* and 56*b*; solenoid-operated on/off valves 58*a* and 58*b*; and a solenoid-operated control valve 37. The outlet of control valve 37 is also connected, via feed line 33, to a solenoid-operated flush valve 60, the outlet of which feeds a hollow, funnel-shaped sump 62. Also connected to the sump 62, through drain lines 64, are containers 200*a* and 200*b*. A bleach line 68 couples the bleach source 52 to a peristaltic pump 50 which in turn is connected to the sump 62 through a check valve 66.

For the purposes of this description only, it is assumed that only two laundry machines 72 are serviced by dispenser 20. In keeping with this assumption, a sump drain line 25 connects the outlet of sump 62 to a three-way, two-position valve 70, and the alternately selectable outlets of valve 70 are connected to laundry machines 72*a* and 72*b*. Between sump 62 and valve 70 are a pump 27, a conductivity sensor 29 and a temperature sensor 30. A pair of two-way valves could be used in lieu of three-way valve 70.

Figure 2A:
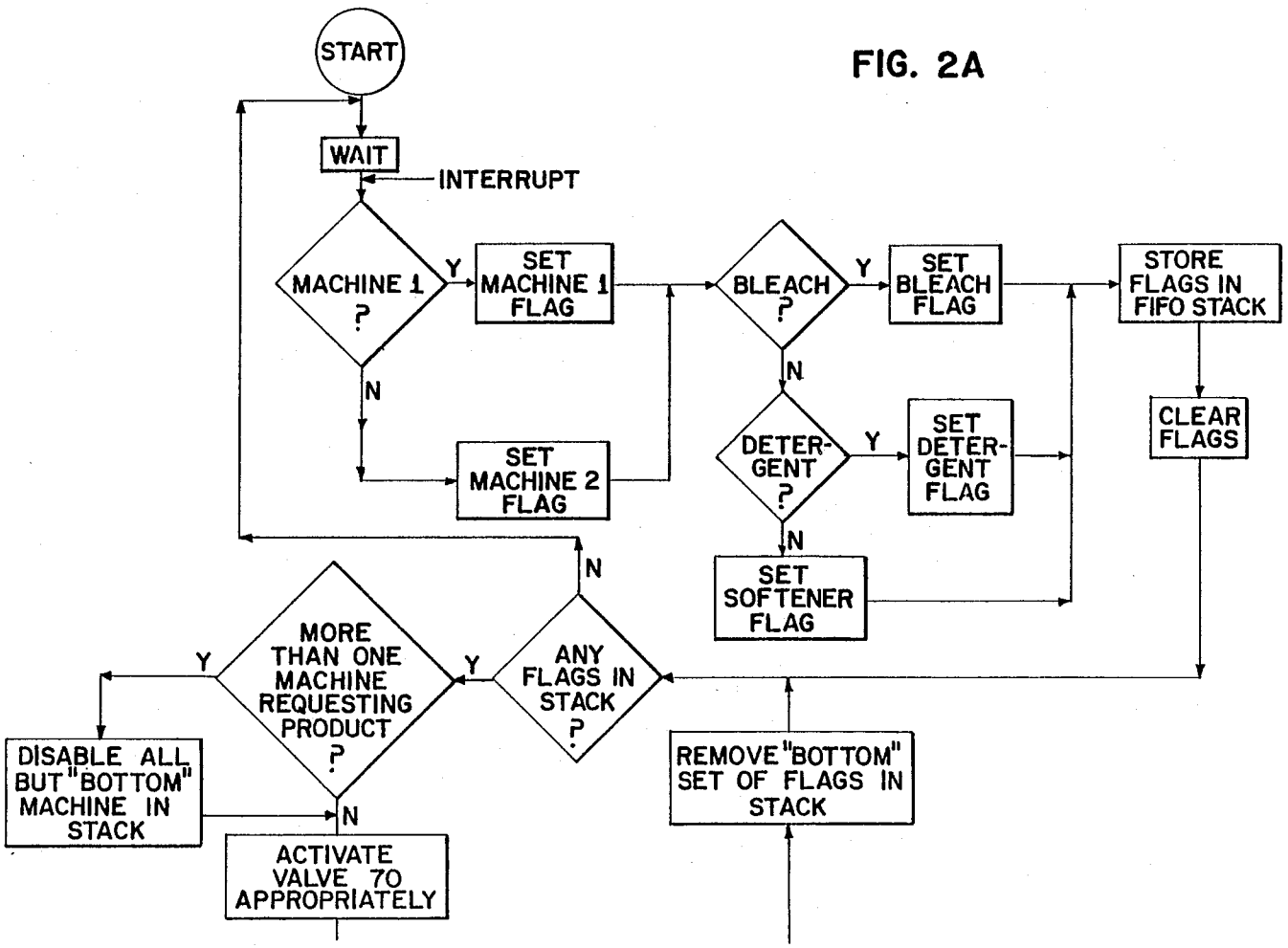
FIG. 2A is a flow chart for a controller suitable for use in the system depicted in FIG. 1.
Figure 2B:
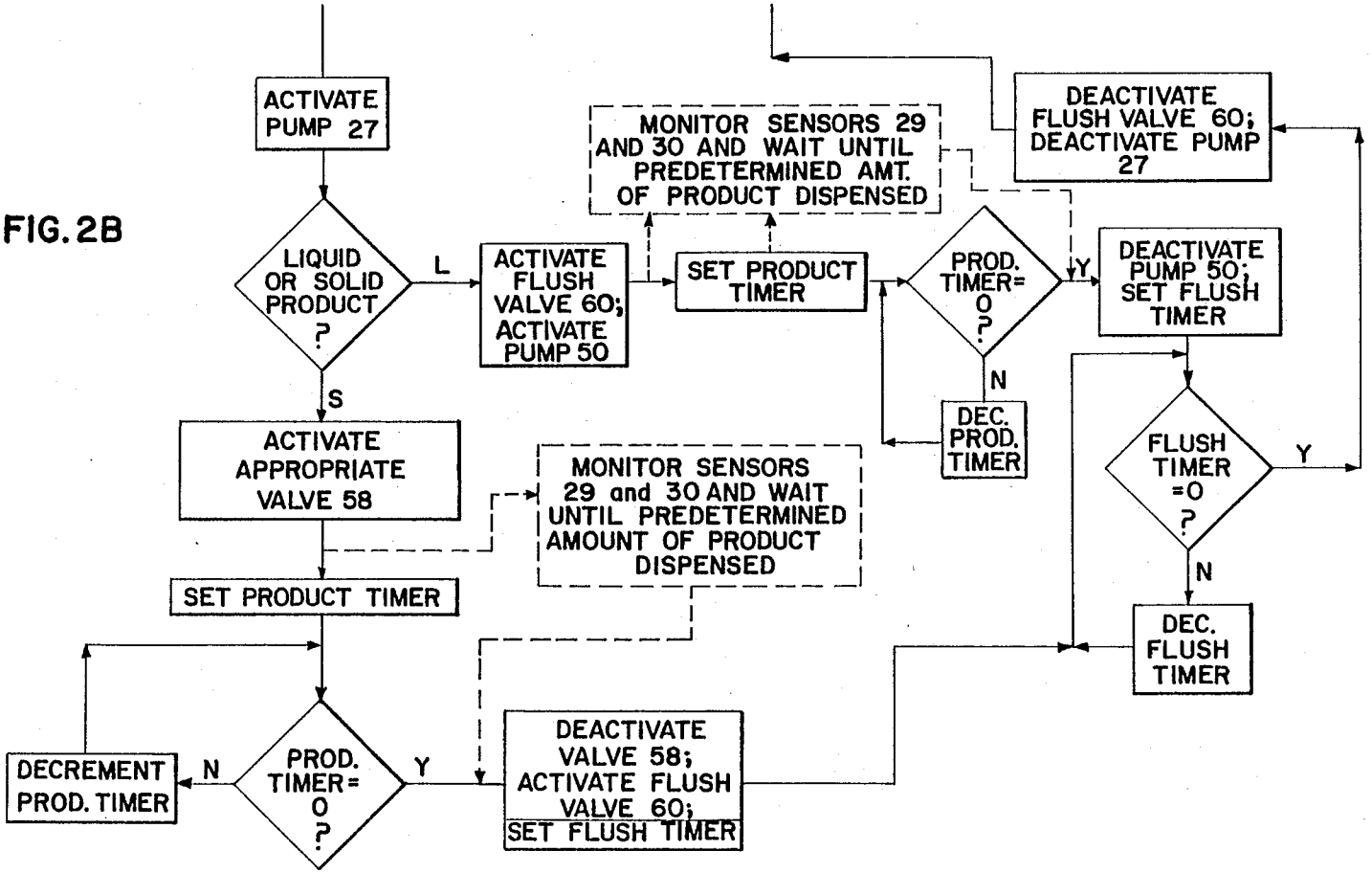
FIG. 2B is a continuation of the flow chart set forth in FIG. 2A.

The electrical components described above and the laundry machines 72 are connected to an electronic control system 74. The signal flow paths interconnecting control system 74 and the various electrical control components of dispenser 20 and laundry machines 72 are shown in dashed line. Control system 74 preferably includes a microprocessor which can readily be programmed to accomplish the tasks described below. FIG. 2 shows a flow chart for a control system 74 program.

Given the detailed description of the operation of system 18 offered below and the flow chart of FIG. 2, those skilled in the art could easily design a circuit or program a microprocessor in accordance therewith. Thus, a detailed circuit diagram and/or program listing need not be discussed. Of course, rather than a computerized system, the control system 74 could be a suitably modified version of the type of control system disclosed in U.S. Pat. No. 3,680,070, incorporated herein by reference.

Electrical power is provided to the electrical control system 74 and all of the electrical components described above. While the power connections for the electrical components of dispenser 20 are not explicitly shown or described above, those skilled in the art will understand that the components must be appropriately empowered.

CHEMICAL FORMULATIONS

Examples of the chemical formulations of the substances supplied by containers 200*a* and 200*b* and bleach source 52 will be described prior to discussing the operation of laundry washing system 18. A preferred highly alkaline detergent for container 200*a* is described in commonly-owned copending application Ser. No. 796,017, filed on Nov. 6, 1985, incorporated herein by reference. A preferred bleach is an aqueous solution of sodium hypochlorite (NaOCl). A preferred solid sour softener is described below.

| Example (Solid Sour Softener) | |
|---|---|
| Raw Materials | Percent |
| Arosurf TA-100[1] | 12 |
| Hexylene Glycol | 13 |
| Sokalan DCS[2] | 75 |
| | 100 |

1-Trademark Sherex Chemical Company (Distearyl Dimethyl Ammonium Chloride)
2-Trademark BASF Germany (mixture of Succinic, Adipic and Glutaric Acids)

The ammonium chloride and hexylene glycol are mixed together and heated to 180° to 190° F. to melt the mixture. The resulting liquid is maintained at 190° to 200° F. while the SOKALAN DCS is added. The mixture is then agitated for 30 minutes and cast in a plastic package.

OPERATION

Preliminary to initiating the laundry cleaning cycle, containers 200*a* and 200*b* should be supplied with appropriate solid laundry detergent and solid sour softener, respectively. In addition, liquid bleach source 52 should be supplied with adequate liquid bleach.

Once the laundry cleaning chemicals are in place, the cleaning cycle can be initiated. Focusing on the operation of laundry machine 72*a*, when machine 72*a* is at the point in its cleaning cycle that it needs laundry detergent, it signals or "interrupts" electrical control system 74 which characterizes the nature and source of the interruption through a series of inquiries shown in FIG. 2. The "flags" which result from the inquiries are stored in a first-in first-out (FIFO) stack and acted upon. If there are no flags in the stack, the control system 74 simply continues to wait for an interruption initiated by one of the machines 72. If the stack indeed contains flags, the program inquiries determine whether there is more than one machine requesting product, in which case control system 74 disables all but the "bottom" (first) machine in the FIFO stack. That is, control system 74 in effect puts all but one machine "on hold" so that it can focus its attention on the machine which made the first request or interruption (as represented by the "bottom" set of flags in the FIFO stack).

Once the latecomers are disabled, if necessary, valve 70 is activated, if necessary, to connect the inlet of valve 70 to the proper outlet so that the appropriate machine 72 is serviced. Pump 27 is then activated. Preferably, pump 27 is capable of running dry without causing excessive wear to its internal components. A diaphragm pump can be used for this purpose. The program then inquiries whether a liquid or solid product is being requested.

Assuming detergent is being requested, the control system 74 opens valve 58*a* to allow a spray of water to dissolve a portion of the detergent within container 200*a*. The resulting detergent solution drains from the bottom of container 200*a* through the associated drain line 64*a* and into the sump 62. A product timer determines a "dispensing period" during which valve 58*a* is held in its open state and valve 58*b* is maintained in its closed state. Also during this time, pump 27 transfers the relatively dilute (approximately 2% to 5%) detergent solution from the sump 62 through discharge line 25 to the three-way valve 70. Valve 70 is controlled by control system 74 so as to be in a position to direct the detergent solution through line 25*a* to laundry machine 72*a*.

It should be noted that electrical control system 74 could monitor the concentration and temperature of the concentrated detergent solution through the use of conductivity sensor 29 and temperature sensor 30, respectively. This information, in conjunction with the flow rate of the solution (constant in some systems), reveals the amount of detergent solution delivered to laundry machine 72*a*. Liquid detergent solution could then be delivered to the laundry machine 72*a* so long as sensors 29 and 30, in conjunction with control system 74, indicate the need for more detergent solution. Typically, the appropriate amount of detergent, sour or bleach for a given machine 72 are predetermined, but the dispensing period may vary in response to changing water pressure and temperature, for instance. Reference is made to commonly-owned application Ser. No. 817,350, filed Jan. 9, 1986, incorporated herein by reference, which discloses a cleaning solution dispenser having a closed-loop control system incorporating a conductivity sensor.

It should also be noted that sensors 29 and 30 could be eliminated if "controlled geometry" solid product dispensers 200 are used. As disclosed in commonly-owned application Ser. Nos. 858,968, filed May 1, 1986; 817,399, filed Jan. 9, 1986; and 796,017, filed Nov. 6, 1985, incorporated herein by reference, the distance between the spray nozzle (not shown) and the solid product can be maintained constant by, for example, allowing the solid product to proceed toward the nozzle as it is dissolved, or by causing the nozzle to telescope toward the solid product as the product is dissolved. If the water pressure and temperature are also substantially invariant, the concentration of detergent and sour in the water flowing out dispensers 200 will remain steady, in which case it is only necessary to control the amount of time that valves 58 are held open. Since feedback sensors are not employed in such a system, it can be termed "open loop" in contrast to the "closed loop" control system discussed above. Generally, any delivery system capable of providing a preselected amount of detergent, sour and bleach during dispensing periods could be employed by dispenser 20.

Following complete delivery of the appropriate amount of detergent solution to laundry machine 72*a* (expiration of product timer in FIG. 2, for example), control system 74 closes valve 58*a* and opens valve 60 to flush sump 62 with fresh water. Valve 60 is held open by control system 74 for a time sufficient to completely purge lines 25 and 25*a* of alkaline detergent, perhaps for 45 to 60 seconds, depending on the length and inside diameter of delivery conduit 25. Flushing is important because the other preferred products, acidic softener and bleach, are chemically incompatible with the detergent. Since all of the products are delivered to laundry machines 72 using a common pump 27 and common line 25, it is preferable to flush the common components of the delivery system with water prior to delivering an incompatible product. Once the flush period has ended, the electrical control system 74 can close valve 60, remove the "flags" from the FIFO stack that were just operated upon, and await another request from a machine 72.

Upon demand by machine 72*a*, or depending on the next set of flags in the FIFO stack, valve 58*b* can be opened to create a pre-diluted solution of acidic softener in a manner similar to the creation and delivery of the alkaline detergent solution. Pump 27 is activated to pump softener solution to valve 70 and to laundry machine 72*a*. The amount of softener solution delivered to laundry machine 72*a* can also be monitored using conductivity sensor 29 and temperature sensor 30 and the delivery period can be terminated once the electrical control system 74 determines that the proper amount of softener solution has been delivered to laundry machine 72*a*. Alternatively, a "controlled geometry" technique could be used. In any event, following the dispensing period, the sump 62 can again be flushed with water by closing softener valve 58*b* and opening water valve 60 for an appropriate period of time, perhaps 45 to 60 seconds, depending on the length and diameter of tubing 25.

When laundry machine 72*a*, for example, signals a need for bleach, the program outlined in FIG. 2 places the appropriate "flags" in the FIFO stack. The program, upon seeing this set of flags, appropriately controls valve 70 and activates pump 27. Then, since a liquid product is being requested, flush valve 60 is immediately opened and pump 50 is activated to cause liquid bleach to flow from bleach reservoir 52 to sump 62. The water and bleach form a solution having a bleach concentration of less than 2%. A product timer is set, and when this timer "times out" pump 50 is deactivated and the "flush timer" is set. Once the flush timer "times out" flush valve 60 is deactivated along with delivery pump 27. Then, so that the control system will not repeat this same process, the "bottom" set of flags in the stack is removed. If there are remaining flags in the stack, the control system 74 again inquires whether there is more than one machine requesting product and follows the procedure outlined above.

It should be stressed that the flushing process is needed because of the incompatible nature of the solutions described above. Of course, if the substances being dispensed are not in any way incompatible, the flushing cycles can of course be eliminated.

The dispenser 20 can be used to deliver solutions of detergent, softener and bleach to a plurality of machines 72. Valve 70 (or, generally, the "valve system") under control of controller 74, can direct cleaning solutions to any one of a plurality of laundry machines 72. As discussed above, control system 74 can simply store the requests from the laundry machines 72 in a first-in first-out register or the like, and act on the requests sequentially in a first-in first-out fashion while disabling the machine(s) 72 not being immediately serviced. Thus, for example, if detergent solution is being dispensed to laundry machine 72*a* at a time when laundry machine 72*b* requests liquid bleach, the control system 74 can temporarily disable machine 72*b* (by, for example, removing power from its rotating control cam(s)). Upon complete delivery of detergent to machine 72*a*, and following the appropriate flushing period, control system 74 will then dispense bleach to machine 72*b*.

It should be stressed that dispenser 20 could service more or less than the two laundry machines 72 shown in the Drawing. A multi-position valve or a bank of two-way on/off valves analogous to two-position valve 70 could be used to direct cleaning solutions to a large plurality of machines, for example. However, those skilled in the art will recognize that as the number of laundry machines 72 increases, the delays will increase since the control system 74 must service each individual request prior to responding to another request from another laundry machine 72. Further with regard to control system 74 and its response to requests from machines 72, the requests could be assigned priorities depending on a number of factors, including the type of product (detergent, softener, or bleach) requested.

It should be stressed that while dispenser 20 can include conductivity and temperature sensors 29 and 30, respectively, the solutions could be delivered to the laundry machines 72 simply on the basis of time. That is, detergent solution, for example, could be delivered to machine 72*a* for a predetermined period of time if it can be assumed that the concentration of detergent in the solution is fairly constant. A "controlled geometry" dispenser can be used in such a system. Also, liquid products (e.g., liquid bleach) can be delivered using a timed system rather than a closed-loop conductivity-controlled system.

The foregoing description, examples, and data are illustrative of the invention described herein, and should not be used to unduly limit the scope of the invention or claims. Since many embodiments and variations can be made while remaining within the spirit and scope of the invention, the invention resides wholly in the claims hereinafter appended.

We claim:

1. A laundry washing system chemical dispenser suitable for dispensing a plurality of chemical solutions to a plurality of utilization points comprising:

(a) a fluid handling system comprising:
  (i) a plurality of chemical solution sources;
  (ii) a single fluidly common means for placing the chemical solution sources in fluid communication with each utilization point, the fluidly common means extending from proximate the chemical solution sources to proximate the utilization points; and
  (iii) means for selectively flushing the fluidly common means; and (b) a control system in operative contact with the fluid handling system suitable for activating the fluid handling system to selectively dispense the chemical solutions to the utilization points during dispensing periods and for selectively activating the flushing means to flush the fluidly common means between dispensing periods, whereby mixing of incompatible chemical solutions within the fluidly common means is prevented.

2. The chemical dispenser of claim 1, wherein the chemical solutions comprise:

(a) an alkaline laundry detergent;
(b) an acidic laundry softener; and
(c) a bleach.

3. The chemical dispenser of claim 2, wherein the chemical solution sources comprise the detergent and softener stored in solid form and the bleach stored in liquid form, and wherein the chemical solution sources comprise means for spraying water at the solid detergent and softener to create solutions therefrom.

4. The chemical dispenser of claim 1, further comprising a conductivity sensor in operative contact with the control system and in fluid communication with the fluidly common means, wherein the control system monitors the concentration of the chemical solution being dispensed and terminates the dispensing period once a predetermined amount of chemical has been dispensed to the utilization point.

5. The chemical dispenser of claim 1, wherein the utilization points comprise a plurality of laundry machines, and wherein the chemical dispenser further comprises selectable means in operative contact with and under control of the control system and in fluid communication with the fluidly common means for directing a selected one of the chemical solutions to a selected one of the laundry machines, whereby the laundry machines can be selectively serviced by the dispenser.

6. The chemical dispenser of claim 5, wherein the laundry machines request chemical solutions and wherein the control system responds to the requests from the laundry machines in first-in first-out fashion whereby the laundry machines which are waiting to be serviced by the dispenser are disabled.

7. The chemical dispenser of claim 6, wherein the control system further includes microprocessor means for responding to the requests from the laundry machines.

8. The chemical dispenser of claim 7, wherein the microprocessor means includes:

(a) chemical data storage means for storing information relating to the chemical solution to be dispensed;
(b) flag storage stack means for storing requests from the laundry machines; and
(c) data processing means for:
  (i) evaluating the first request in the flag storage stack means;
  (ii) retrieving information from the chemical data storage means relating to the request;
  (iii) disabling any laundry machine which is requesting service until the laundry machine's request can be responded to; and
  (iv) controlling the fluid handling system and the selectable means in order to direct the chemical solution requested to the requesting laundry machine.

9. The chemical dispenser of claim 1, wherein the chemical solutions comprise chemical solutions at least two of which are non-compatible with one another, the fluidly common means is open to the atmosphere proximate the chemical solution sources, and the control system is cooperatively connected to the utilization point and responds to requests from the utilization point to activate the fluid handling system.

10. A chemical dispenser suitable for dispensing a detergent, a laundry softener, and a bleach to a plurality of laundry machines, comprising:

(a) a source of solid detergent;
(b) a source of solid softener;
(c) a source of liquid bleach;
(d) a valve system having an inlet and a plurality of selectable outlets, wherein each outlet of the valve system is connected to one of the laundry machines;

(e) a source of water;

(f) a sump having an inlet in fluid communication with the detergent, softener, bleach and water sources and an outlet in fluid communication with the valve system inlet;

(g) a delivery pump having an inlet in fluid communication with the outlet of the sump and an inlet in fluid communication with the inlet of the valve system; and (h) a control system in operative contact with the source of water, the delivery pump, and the valve system, wherein when the machines need detergent, softener or bleach they signal the control system, and wherein the control system responds to such signals in first-in, first-out fashion by:

(i) controlling the valve system to place the inlet thereof in fluid communication with the appropriate outlet;

(ii) if a solid product is requested, placing the water source in fluid communication with the solid product source for a predetermined dispensing period to produce an aqueous solution, and directing the aqueous solution to the inlet of the sump; or if bleach is requested, pumping the bleach to the inlet of the sump and placing the water source in fluid communication with the sump inlet to dilute the bleach for a predetermined dispensing period;

(iii) activating the delivery pump to deliver the product to the requesting machine; and (iv) subsequently flushing the sump, delivery pump, and the valve system with water, whereby the detergent, softener and bleach can be alternately delivered to the laundry machines in spite of their chemical incompatibility.

11. A laundry washing system comprising:

(a) a laundry machine of the type which utilizes a plurality of chemical solutions;

(b) a fluid handling system comprising:

(i) a plurality of chemical solution sources at least two of which sources are incompatible with one another;

(ii) a single fluidly common means for placing the chemical solution sources in fluid communication with the laundry machine, the single fluidly common means being located mainly external to the laundry machine; and (iii) means for flushing the fluidly common means; and (c) a control system, in operative contact with the fluid handling system and cooperatively connected to the laundry machine, suitable for activating the fluid handling system upon receiving a request from the laundry machine for a chemical solution to alternately dispense the chemical solutions to the laundry machine during dispensing periods and for activating the flushing means to flush the fluidly common means between dispensing periods whereby incompatible chemical solutions may be successively dispensed.

12. The system of claim 11, wherein the chemical solutions comprise:

(a) an alkaline laundry detergent;

(b) an acidic laundry softener; and (c) a bleach.

13. The laundry washing system of claim 12, wherein the chemical solution sources comprise the detergent and softener stored in solid form and the bleach stored in liquid form, and wherein the chemical solution sources comprise means for spraying water at the solid detergent and softener to create solutions therefrom.

14. The system of claim 11, further comprising a conductivity sensor in operative contact with the control system and in fluid communication with the fluidly common means, wherein the control system monitors the concentration of the chemical solution being dispensed and terminates the dispensing period once a predetermined amount of chemical has been dispensed to the utilization point.

15. The system of claim 11, further comprising a plurality of laundry machines, and wherein the fluidly common means further comprises selectable means, in operative contact with and under control of the control system and in fluid communication with the fluidly common means, for directing a selected one of the chemical solutions to a selected one of the plurality of laundry machines, whereby selected solutions may be selectively delivered to the laundry machines.

16. The laundry washing system of claim 15, wherein the laundry machines request chemical solutions and wherein the control system responds to the requests from the laundry machines in first-in first-out fashion whereby the laundry machines which are waiting for solutions to be delivered are disabled.

17. The chemical dispenser of claim 16, wherein the control system further includes microprocessor means for responding to the requests from the laundry machines.

18. The chemical dispenser of claim 17, wherein the microprocessor means includes:

(a) chemical data storage means for storing information relating to the chemical solution to be dispensed;

(b) flag storage stack means for storing requests from the laundry machines; and (c) data processing means for:

(i) evaluating the first request in the flag storage stack means;

(ii) retrieving information from the chemical data storage means relating to the request;

(iii) disabling any laundry machine which is requesting service until the laundry machine's request can be responded to; and (iv) controlling the fluid handling system and the selectable means in order to direct the chemical solution requested to the requesting laundry machine.

19. The system of claim 11, wherein the fluidly common means is open to the atmosphere proximate the chemical solution sources.

20. A laundry washing system comprising:

(a) a plurality of laundry machines;

(b) a source of solid detergent;

(c) a source of solid softener;

(d) a source of liquid bleach;

(e) a valve system having an inlet and a plurality of selectable outlets, wherein each outlet of the valve system is connected to one of the laundry machines;

(f) a source of water;

(g) a sump having an inlet in fluid communication with the detergent, softener, bleach and water sources and an outlet in fluid communication with the valve system inlet;

(h) a delivery pump having an inlet in fluid communication with the outlet of the sump and an inlet in fluid communication with the inlet of the valve system; and (i) a control system in operative contact with the source of water, the delivery pump, and the valve system, wherein when the machines need detergent, softener or bleach they signal the control system, and wherein the control system responds to such signals in first-in, first-out fashion by:

(i) controlling the valve system to place the inlet thereof in fluid communication with the appropriate outlet;

(ii) if a solid product is requested, placing the water source in fluid communication with the solid product source for a predetermined dispensing period to produce an aqueous solution, and directing the aqueous solution to the inlet of the sump; or if bleach is requested, pumping the bleach to the inlet of the sump and placing the water source in fluid communication with the sump inlet to dilute the bleach for a predetermined dispensing period;

(iii) activating the delivery pump to deliver the product to the requesting machine; and (iv) subsequently flushing the sump, delivery pump, and the valve system with water, whereby the detergent, softener and bleach can be alternately delivered to the laundry machines in spite of their chemical incompatibility.

21. A laundry washing system chemical dispenser suitable for dispensing a plurality of chemical solutions to a plurality of laundry machines comprising:

(a) a fluid handling system comprising:

(i) a plurality of chemical solution sources;

(ii) a single first fluidly common means for collecting the chemical solutions from the chemical solutions sources;

(iii) a plurality of second fluidly common means for placing the chemical solutions in fluid communication with the laundry machines, whereby there is a second fluidly common means corresponding to each laundry machine; and (iv) switchable means, in fluid communication with the first and second fluidly common means, for directing the chemical solutions to a selected second fluidly common means corresponding to a selected laundry machine;

(v) means for selectively flushing the first fluidly common means, switchable means and second fluidly common means.

(b) control system means, in operative contact with the fluid handling system, for activating the fluid handling system to selectively dispense the chemical solutions to the utilization point during dispensing periods and for selectively activating the flushing means to flush the switchable means and first and second fluidly common means between dispensing periods so as to prevent mixing of incompatible chemical solutions within the switchable means and first and second fluidly common means.

* * * * *